US007669296B2

(12) United States Patent
Yokoyama et al.

(10) Patent No.: US 7,669,296 B2
(45) Date of Patent: Mar. 2, 2010

(54) SLIDE FASTENER

(75) Inventors: Yutaka Yokoyama, Taipei (TW); Chien Min Chen, Taipei (TW)

(73) Assignee: YKK Corporation, Tokyo (JP)

( * ) Notice: Subject to any disclaimer, the term of this patent is extended or adjusted under 35 U.S.C. 154(b) by 614 days.

(21) Appl. No.: 11/487,752

(22) Filed: Jul. 17, 2006

(65) Prior Publication Data

US 2007/0017071 A1 Jan. 25, 2007

(30) Foreign Application Priority Data

Jul. 19, 2005 (JP) ..... 2005-208900
Jul. 10, 2006 (JP) ..... 2006-189581

(51) Int. Cl.
*A44B 19/36* (2006.01)

(52) U.S. Cl. ..... 24/436; 24/388

(58) Field of Classification Search ..... 24/381, 24/385, 387, 388, 433, 434, 436
See application file for complete search history.

(56) References Cited

U.S. PATENT DOCUMENTS 3,353,233 A * 11/1967 Frohlich ..... 24/436
3,862,474 A * 1/1975 Ebata ..... 24/436
3,905,073 A * 9/1975 Fukuroi ..... 24/436
3,906,594 A * 9/1975 Takahashi et al. ..... 24/436
3,964,137 A * 6/1976 Kihara ..... 24/401
3,972,095 A * 8/1976 Kandou ..... 24/436
4,155,147 A * 5/1979 Akashi ..... 24/436
4,267,621 A * 5/1981 Akashi ..... 24/396
4,878,275 A 11/1989 Kazui et al.
7,150,080 B2 * 12/2006 Kaetsu ..... 24/436
7,231,697 B2 * 6/2007 Takamatsu et al. ..... 24/436

FOREIGN PATENT DOCUMENTS

| | | |
|---|---|---|
| CN | 497392 | 8/2002 |
| EP | 1 430 804 A1 | 6/2004 |
| EP | 1 516 553 A1 | 3/2005 |
| EP | 1 543 739 A2 | 6/2005 |
| GB | 2016077 A | 9/1979 |
| GB | 2096693 A | 10/1982 |

* cited by examiner

*Primary Examiner*—Robert J Sandy
(74) *Attorney, Agent, or Firm*—Alston & Bird, LLP

(57) ABSTRACT

The invention provides a slide fastener with a top end stop, wherein a linear fastener element row is sewed on the fastener tape, the top end stop is formed by burying linear fastener elements facing a space portion with synthetic resin, a projecting portion 11 to be in contact with a slider is formed on a side surface of the top end stop for preventing the slider from slipping out, a protrusion protruded upward along the sewing thread is formed on a front surface of the top end stop, a groove is carved in a center longitudinal direction of the protrusion, and the sewing thread is prevented from being deflected and exposed on the front surface of the top end stop by being pressed by a projecting ridge provided in a molding die for forming the groove toward the linear fastener elements.

8 Claims, 16 Drawing Sheets

SLIDE FASTENER

BACKGROUND OF THE INVENTION

1. Field of the Invention

The present invention relates to a slide fastener having a top end stop made of synthetic resin which is attached integrally with molding means to a space portion formed on a fastener chain such that the top end stop is adjacent to a linear fastener element row in a fastener chain configured such that coil-like or zigzag-like linear fastener element rows made of synthetic resin are attached to opposing side edges of a pair of fastener tapes with sewing means.

2. Description of the Related Art

In a conventional top end stop for a slide fastener disclosed by Republic of China Patent No. 497392, linear fastener element rows made of synthetic resin are attached to opposing side edges of fastener tapes in a fastener chain with sewing means, and top end stops made of synthetic resin are formed by injection molding at top end portions of the linear fastener element rows. When coil-like linear fastener element rows are attached to opposing side edges of fastener tapes 103 by sewing means and top end stops 110 made of synthetic resin are attached to the top ends so as to be adjacent to the linear fastener element rows as shown in, for example, FIG. 19, a single coil-like linear fastener element 121 at the top end of each of the linear fastener element rows, that is, a 1-cycle coil-like linear fastener element 121 continuous in an order of its lower leg portion, inverted portion, upper leg portion and coupling head at the top end portion is buried in one of the top end stops 110 made of synthetic resin to cover the coil-like linear fastener element 121.

According to the top end stop 110 of the coil-like linear slide fastener shown in FIG. 19, a 1-cycle coil-like linear fastener element 121 is buried in the top end stop 110 made of synthetic resin at the top end portion of the coil-like linear fastener element row which is attached to each of the opposing side edges of the fastener tapes 103 with sewing means, so that the coil-like linear fastener element 121 is covered. However, because the coil-like linear fastener element 121 covered by burying is only a 1-cycle coil-like linear fastener element 121, mounting strength of the top end stop 110 is very weak and unstable. If a large pulling force is applied to a slider 128 in a state in which the slider 128 makes contact with the top end stop 110, the top end stop 110 slips off the coil-like linear fastener element 121, so that the slider 128 may escape from the coil-like linear fastener element row, which is a problem to be solved.

SUMMARY OF THE INVENTION

The present invention has been achieved in view of the above-described problem, and a first object of the present invention is to provide a slide fastener having a coil-like or zigzag-like linear slide fastener element row wherein a top end stop is molded integrally or in a same unit with a plurality of coil-like or zigzag-like linear slide fastener elements so that the top end stop never slips off the linear fastener elements and the top end stop is strongly and stably fixed to a fastener chain.

In addition to the first object, a second object of the present invention is to provide a slide fastener capable of sufficiently exerting a function of the top end stop in such a manner that a projecting portion is provided so as to make contact with a flange of the slider for guiding the linear fastener elements.

In addition to the first object, a third object of the present invention is to provide a slide fastener capable of sufficiently exerting a function of the top end stop in such a manner that an expanding portion is provided so as to make contact with a diamond of the slider for guiding the linear fastener elements.

In addition to the second or third object, a fourth object of the present invention is to provide a slide fastener capable of sufficiently exerting a function of the top end stop by specifying positions at which the projecting portion and the expanding portion to be provided on the top end stop are located.

In addition to the first object, a fifth object of the present invention is to provide a slide fastener whose attachment strength to the fastener tape can be increased in such a manner that the top end stop is formed over a front surface side and a rear surface side of the fastener tape.

In addition to the first object, a sixth object of the present invention is to provide a slide fastener with high quality in which a sewing thread in a space portion remained on the fastener tape is prevented beforehand from being deflected by an injection pressure in molding the top end stop and exposed on a front surface of the top end stop by a feature that the linear fastener element row is sewed on the fastener tape and a protrusion is protruded toward a front surface portion of the main body portion on an upper side of, i.e., on the sewing thread.

In addition to the sixth object, a seventh object of the present invention is to provide a slide fastener with high quality in which the sewing thread is prevented beforehand from being lifted and deflected by a molding die at a time of molding the top end stop by a feature that the linear fastener element row is sewed on the fastener tape and a groove is provided in a center of the protrusion formed on the upper side of, i.e., on the sewing thread.

In addition to the first object, an eighth object of the present invention is to provide a slide fastener with high quality in which the sewing thread is prevented beforehand from being lifted and deflected by a molding die for forming the groove at a time of molding the top end stop by a feature that the linear fastener element row is sewed on the fastener tape and a groove is provided on the upper side of, i.e., on the sewing thread.

In addition to the second object, a ninth object of the present invention is to provide a slide fastener in which the projecting portion formed on the main body portion of the top end stop to be in contact with the flange of the slider is formed thick and strong so as to prevent the projecting portion from being broken when the slider hit it hard.

According to a first aspect of the present invention to achieve the above-described objects, there is provided a slide fastener having a coil-like or zigzag-like linear slide fastener element row, the slide fastener being characterized in that a fastener stringer is formed by attaching a coil-like or zigzag-like linear fastener element row with a sewing thread along each of opposing side edges of fastener tapes, a top end stop made of synthetic resin is attached adjacent to a top end portion of the linear fastener element row with injection molding means so as to mold a main body portion in such a manner that the top end stop buries and covers a plurality of adjoining linear fastener elements and fills gaps among the adjoining linear fastener elements.

According to a second aspect of the invention, in addition to a configuration of the first aspect, there is provided a slide fastener characterized in that the top end stop has a projecting portion which projects from an inner side surface located inside the fastener tape in the main body and which makes contact with a front end of a flange installed on a body of a slider, the projecting portion being provided to the main body portion.

According to a third aspect of the invention, in addition to the configuration of the first aspect, there is provided a slide fastener characterized in that the top end stop has an expanding portion which expands outwardly from an outer side surface located outside of the fastener tape on an opposite side to the inner side surface in the main body and which makes contact with a diamond located in the body of the slider, the expanding portion being provided to the main body portion.

According to a fourth aspect of the invention, in addition to a configuration of the second or third aspect, there is provided a slide fastener characterized in that the projecting portion formed on the inner side surface and the expanding portion formed on the outer side surface of the main body portion of the top end stop are formed on an upper end sides of the inner side surface and the outer side surface of the main body portion.

According to a fifth aspect of the invention, in addition to the configuration of the first aspect, there is provided a slide fastener characterized in that the main body portion of the top end stop comprises a front surface portion formed on a front surface side of the fastener tape in which the plurality of linear fastener elements are buried and a rear surface portion formed on a rear surface side of the fastener tape so as to be continuous to the front surface portion.

According to a sixth aspect of the invention, in addition to the configuration of the first aspect, there is provided a slide fastener characterized in that the coil-like or zigzag-like linear fastener element row is sewed along each of the opposing side edges of the fastener tapes and the protrusion is protruded on the front surface portion of the main body portion of the top end stop on the upper side of, i.e., on the sewing thread.

According to a seventh aspect of the invention, in addition to the configuration of the sixth aspect, there is provided a slide fastener characterized in that the groove in a concave shape is carved with respect to a front surface of the protrusion formed on the main body portion of the top end stop.

According to an eighth aspect of the invention, in addition to the configuration of the first aspect, there is provided a slide fastener characterized in that the coil-like or zigzag-like linear fastener element row is sewed along each of the opposing side edges of the fastener tapes and the groove is carved with respect to the front surface portion of the main body portion of the top end stop on the upper side of, i.e., on the sewing thread along the sewing thread.

According to an eighth aspect of the invention, in addition to the configuration of the first aspect, there is provided a slide fastener characterized in that the projecting portion to be in contact with the flange of the slider is formed in a shape that a front surface of the projecting portion is protruded higher than a front surface of the main body portion.

With respect to effects of the present invention, according to the first aspect, the top end stop can be integrally molded with the linear fastener element row easily, and further, can be strongly and stably fixed to the fastener chain.

According to the second aspect of the invention, in addition to the effect of the first aspect, the top end stop can make a secure contact with the flange for guiding the slider to stop a sliding motion of the slider.

According to the third aspect of the invention, in addition to the effect of the first aspect, the top end stop can securely stop the sliding motion of the slider by bringing the expanding portion into contact with the diamond for guiding the slider.

According to the fourth aspect of the invention, in addition to the effect of the second or third aspect, the projecting portion and the expanding portion can be used effectively as the top end stop, and the projecting portion and the expanding portion are brought into a secure contact with the slider to thereby stop the sliding motion of the slider.

According to the fifth aspect of the invention, in addition to the effect of the first aspect, the attachment strength of the top end stop to the fastener tape can be improved by increasing a contact area between the top end stop and the fastener tape. As described above, the effects which can be exerted by the present invention are considerable.

According to the sixth aspect of the invention, in addition to the effect of the first aspect, the sewing thread in the space portion remained on the fastener tape can be prevented beforehand from being exposed on the front surface of the top end stop, even if it is deflected by the injection pressure in molding the top end stop since the sewing thread is in a slack state, thereby forming a beautiful top end stop with high quality.

According to the seventh aspect of the invention, in addition to the effect of the sixth aspect, the sewing thread can be surely prevented from being disposed on the front face of the top end stop, thereby forming the beautiful top end stop with high quality, since the sewing thread in the slack state can be tightened up by being pressed with respect to an upper leg portion of a linear fastener element by the molding die for forming the groove in molding the top end stop.

According to the eighth aspect of the invention, in addition to the effect of the first aspect, the sewing thread can be surely prevented from being disposed on the front face of the top end stop, thereby forming the beautiful top end stop with high quality, since the sewing thread in the slack state can be tightened up by being pressed with respect to the upper leg portion of the linear fastener element by the molding die for forming the groove in molding the top end stop.

According to the ninth aspect of the invention, in addition to the effect of the second aspect, the projecting portion of the top end stop to be in contact with the flange of the slider can be formed thick and strong so as to prevent the projecting portion from being broken when the slider hit it hard. As aforementioned, the effects exerted by the invention are quite remarkable.

DESCRIPTION OF THE PREFERRED EMBODIMENTS

Figure 1:
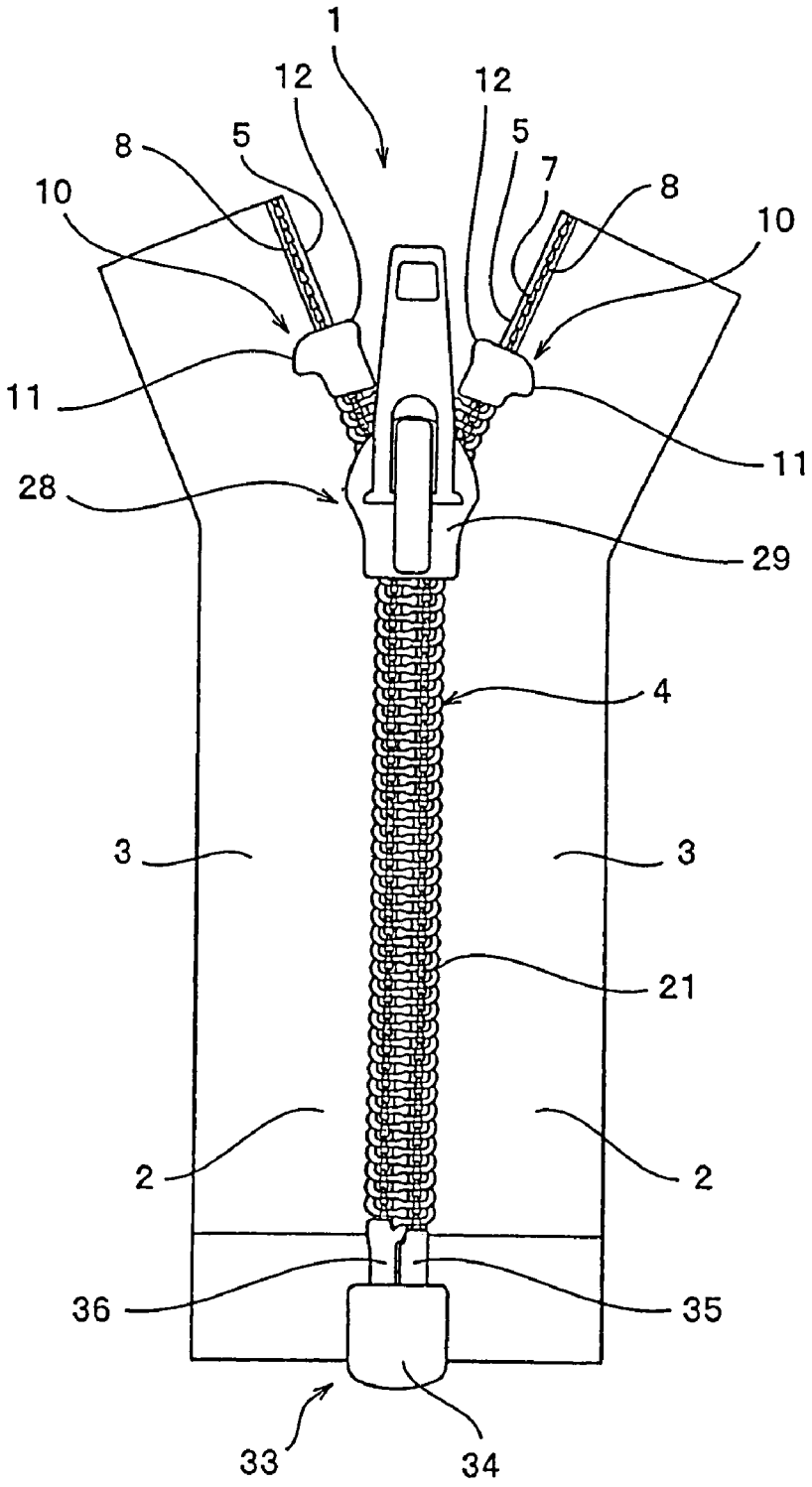
FIG. 1 is a front view of a linear slide fastener with a top end stop.

According to a top end stop of a coil-like or zigzag-like linear slide fastener element row of the present invention, as shown in FIGS. 1 to 8, coil-like or zigzag-like linear fastener element rows 4 made of synthetic resin are attached to opposing side edges 5 of a pair of right and left fastener tapes 3 by sewing with a sewing thread 7 through a core thread 6, so that right and left fastener stringers 2 are formed. A top end stop 10 is molded with injection molding means using synthetic resin and attached to a top end portion of each of the linear fastener element rows 4.

The top end stop 10 is formed by injection molding using synthetic resin so as to make contact with a liner fastener element 21 at the top end portion of the linear fastener element row 4 attached to each of the opposing side edges 5 of the fastener tapes 3. At this time, a plurality of linear fastener elements 21 are buried and covered with synthetic resin, and a gap between adjoining linear fastener elements 21 is filled with injected synthetic resin. As a result, not only the linear fastener elements 21 but also the core thread 6 and sewing thread 7 existing on front and rear surfaces and opposing side edge 5 of the fastener tape 3 which are disposed around the linear fastener elements 21 are covered and buried.

The top end stop 10 has a main body portion 13 which covers the plurality of linear fastener elements 21 by burying. The main body portion 13 is formed on a front surface and a rear surface of the fastener tape 3 so as to stride over each of the opposing side edges 5 of the fastener tapes 3. As a result, the top end stop has a substantially C-shaped section. The main body portion 13 is comprised of a front surface portion 14 and a rear surface portion 15. The front surface portion 14 is formed on a front surface side of the fastener tape 3 to cover the plurality of linear fastener elements 21, the core thread 6, the sewing thread 7 and the front surface of the fastener tape 3, the core thread 6, the sewing thread 7 and the front surface of the fastener tape 3 being disposed around the fastener elements 21. The rear surface portion 15 is formed on a rear surface side of the fastener tape 3 to cover the sewing thread 7 existing on the rear surface of the fastener tape 3. The front surface portion 14 is formed thicker than the rear surface portion 15. The main body portion 13 includes an outer side surface 16, an inner side surface 17, a top end surface 18 and a bottom end surface 19. The outer side surface 16 and inner side surface 17 oppose each other in a width direction of the fastener tape 3. The top end surface 18 and bottom end surface 19 oppose each other in a longitudinal direction of the fastener tape 3.

An expanding portion 12 which expands outwardly is formed near a top end surface 18 on an outer side surface 16 on a side of a coupling head 22 of the linear fastener element 21, and the expanding portion 12 makes contact with a side surface of a diamond 30 formed in a body 29 of a slider 28. Further, a projecting portion 11 which projects inwardly of the fastener tape 3 is provided near the top end surface 18 on an inner side surface 17 on a side of an inverted portion 23 of the linear fastener element 21. The projecting portion 11 is configured so as to make contact with a front end of a flange 31 formed in the body 29 of the loaded slider 28.

As shown in FIG. 1, the other end portion of the linear fastener element row 4 may be constructed to be openable by attaching an opening device 33 including a box 34, a box pin 35 and an insert pin 36 or to be closed by attaching a bottom end stop instead of the opening device 33. With respect to the fastener stringer 2 provided with the top end stop 10, the top end stop 10 buries the core thread 6, the sewing thread 7 and the side edge of the fastener tape 3 as well as the plurality of liner fastener elements 21. Even when the body 29 of the slider 28 makes contact with the top end stop 10 due to the sliding motion of the slider 28, the top end stop 10 is firmly fixed to the end portion of the linear fastener element row 4. Additionally, a durable top end stop of a linear slide fastener can be obtained without any particular treatment on the body 29 of the slider 28.

According to a top end stop of a coil-like or zigzag-like linear slide fastener element row of another embodiments of the present invention, as shown in FIGS. 9 to 15, the coil-like or zigzag-like linear fastener element rows 4 made of synthetic resin are attached to the opposing side edges 5 of the pair of right and left fastener tapes 3 by sewing with a double-chain-stitch sewing thread 7 with the core thread 6 inserted therein, so that a fastener chain 1 is formed. The linear fastener element row 4 is cut and removed by a predetermined length from the fastener chain 1 so as to form a space portion 8. The top end stop 10 made of the synthetic resin is injection molded on an end portion of the linear fastener element row 4 by using this space portion 8.

As to a shape of the top end stop, the main body portion 13 is formed in a shape burying and covering a plurality of the linear fastener elements 21 sewed and attached on a front surface side of the fastener tape 3. A shape of a plain surface of the main body portion 13 is same as that of the aforementioned embodiment, however, a protrusion 37 protruding in a longitudinal direction of the main body portion 13 is formed in the front surface portion 14 of the main body portion 13 on an upper side, i.e., on the sewing thread used for sewing the linear fastener element row 4, and a groove 38 in a concave shape is also formed in a center of the protrusion 37.

The protrusion 37 of the top end stop 10 can get in and out of a guide groove 32 of the slider 28, however, it is formed in a shape preventing a rattle of the top end stop in the guide groove. Furthermore, the protrusion 37 also covers the sewing thread 7 so as not to be exposed on a front surface of the top end stop 10, even if a position of the sewing thread 7 is deflected to a side of the front surface of the top end stop 10 by a injection pressure in molding the top end stop 10. Furthermore, in molding the top end stop 10, a projection formed in a die for forming the groove 38 presses the sewing thread 7 in a slack state in the space portion 8 formed in the fastener chain 1 from above for tightening the sewing thread 7 so as to prevent the sewing thread 7 beforehand from exposing on the front surface portion 14 of the top end stop 10, thereby forming the top end stop 10 with high quality.

First Embodiment

A top end stop of a slide fastener having a coil-like or zigzag-like linear slide fastener element row according to a first embodiment of the present invention will be described below. According to the top end stop of the linear slide fastener according to the first embodiment shown in FIGS. 1 to 7, monofilaments made of synthetic resin such as polyamide or polyester are formed in a coil-like or zigzag-like manner on opposing side edges 5 of a pair of right and left fastener tapes 3 in fastener stringers 2. Then, a linear fastener element row 4 is formed which is configured by a plurality of linear fastener elements 21 adjoining one another in a longitudinal direction of the fastener tapes 3. A core thread 6 is inserted into an inside of the linear fastener element row 4, and the core thread 6 and linear fastener element row 4 are attached to the side edge of each of the fastener tapes 3 by sewing with a sewing thread 7. Each of the linear fastener elements 21 is formed of a coupling head 22 which projects outwardly from the side edge of the fastener tape 3, an inverted portion 23 located inside the fastener tape 3, and an upper leg portion 24 and a lower leg portion 25 for connecting the coupling head 22 with the inverted portion 23. The core thread 6 is inserted into an internal space surrounded by the coupling head 22, the inverted portion 23, the upper leg portion 24 and the lower leg portion 25. The linear fastener element row 4 is configured such that the plurality of linear fastener elements 21 are arranged in the longitudinal direction of the fastener tapes 3, so that right and left linear fastener element rows 4 can engage or disengage each other.

Figure 2:
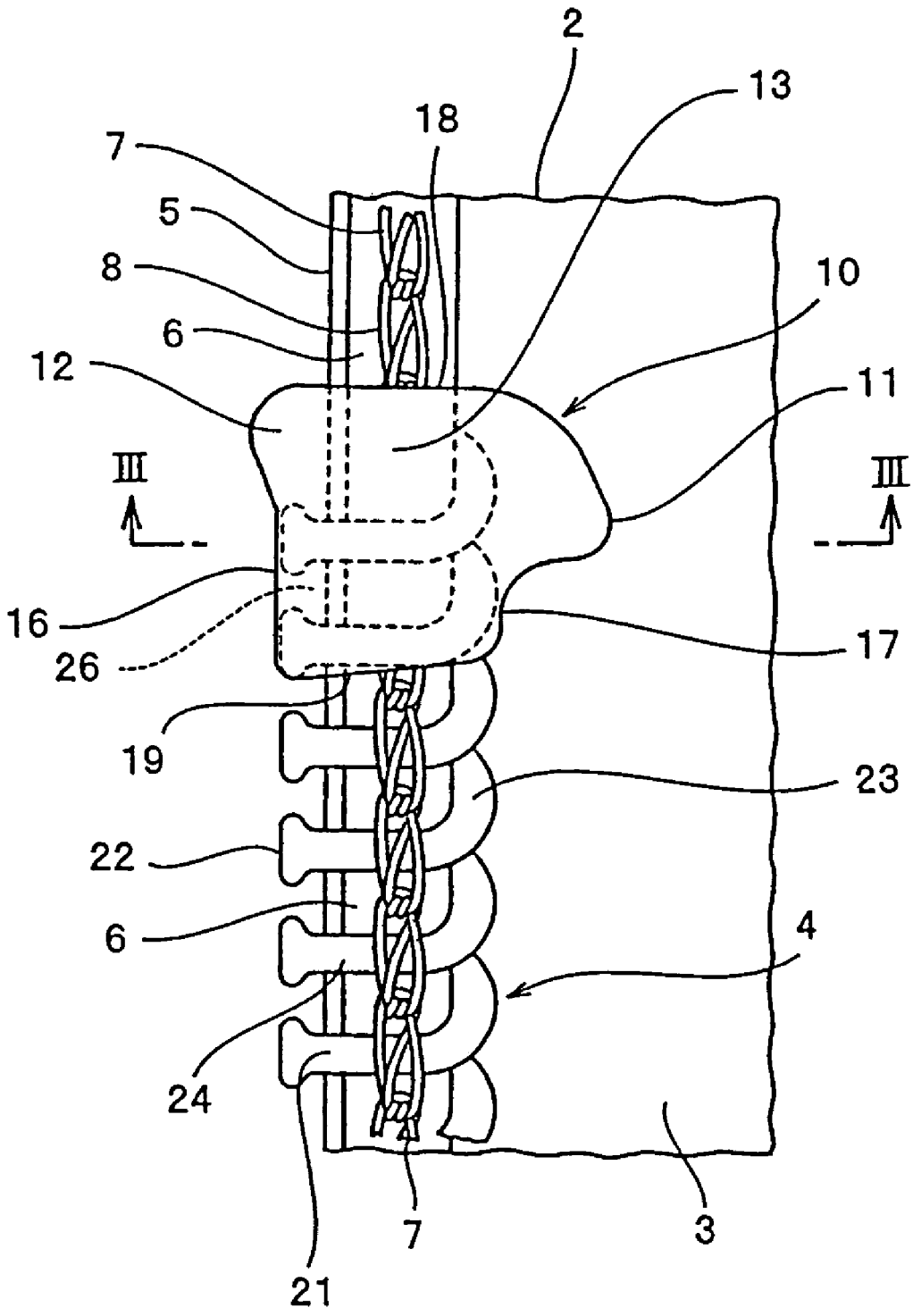
FIG. 2 is a front view of a top end stop disposed on one fastener stringer.
Figure 3:
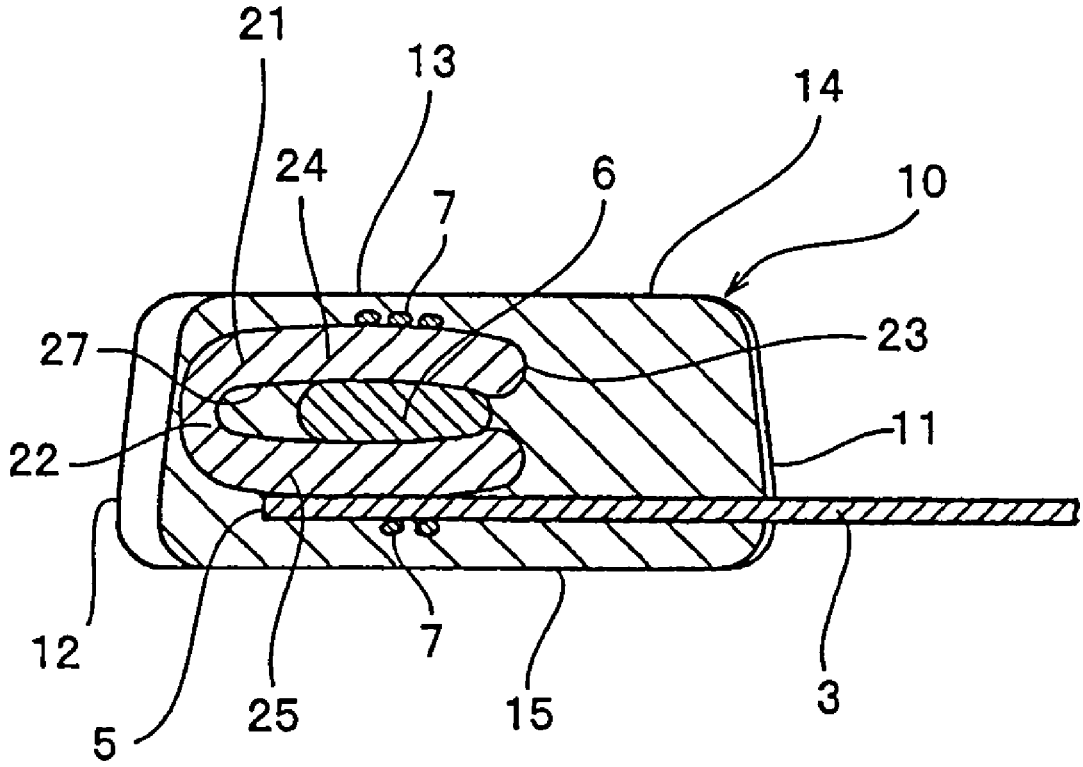
FIG. 3 is a sectional view of the top end stop taken along the line III-III in FIG. 2.
Figure 4:
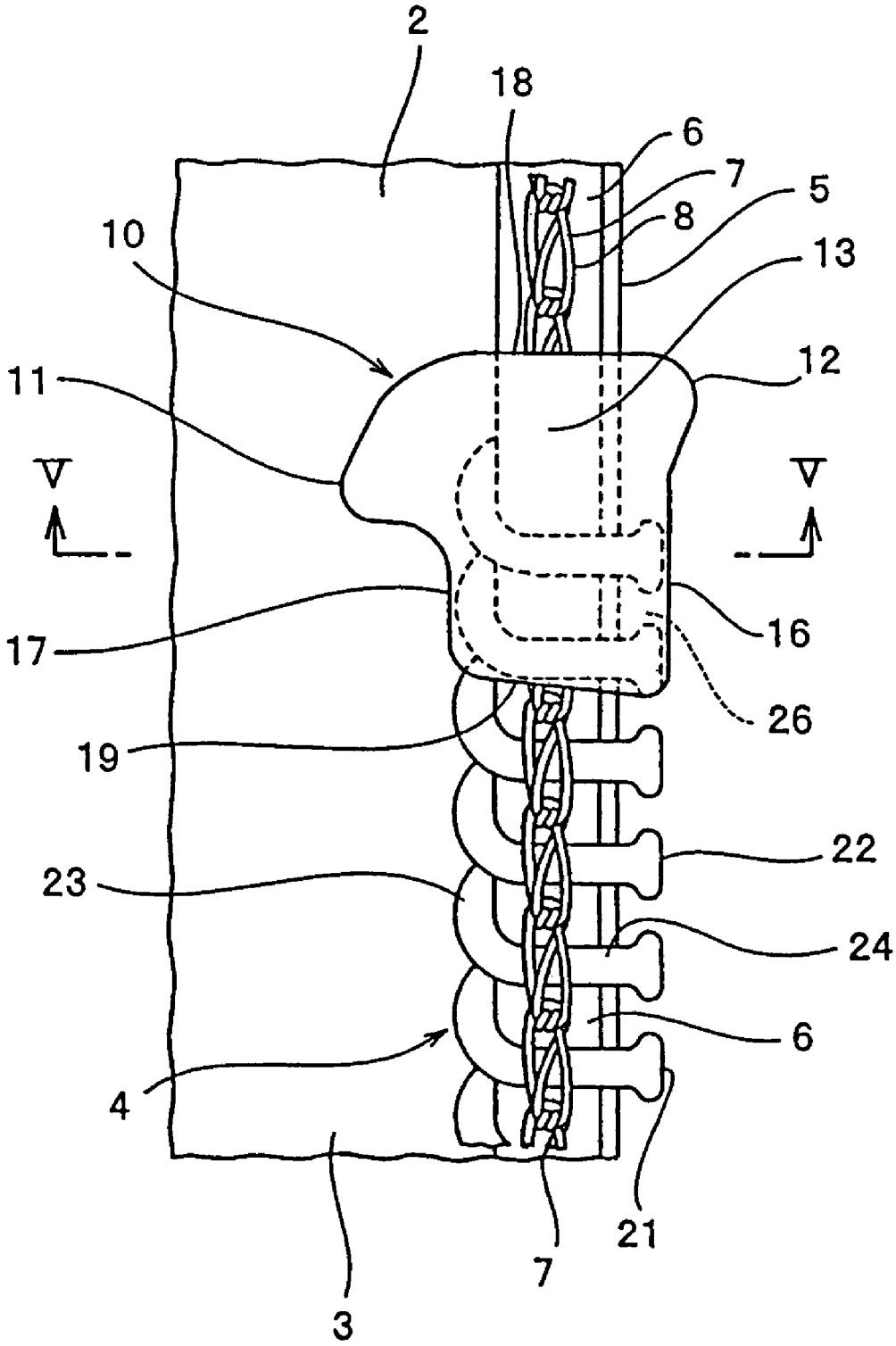
FIG. 4 is a front view of a top end stop disposed on the other fastener stringer.
Figure 5:
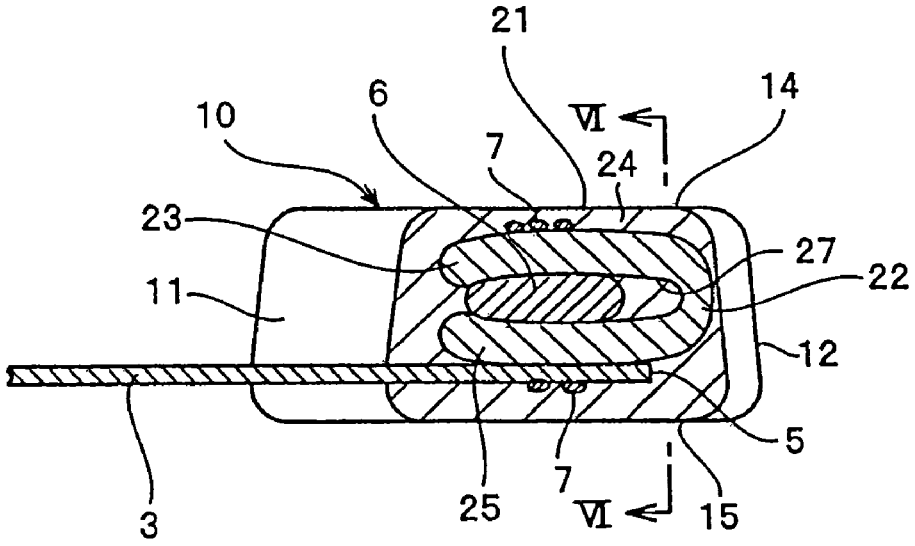
FIG. 5 is a sectional view of the top end stop taken along the line V-V in FIG. 4.
Figure 6:
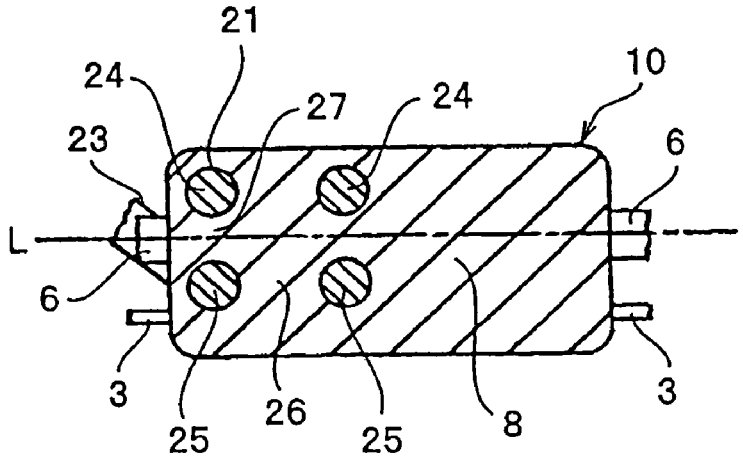
FIG. 6 is a sectional view of the top end stop taken along the line VI-VI in FIG. 5.

The top end stop 10 is provided on each of the right and left fastener stringers 2 which configure a fastener chain 1. The top end stop 10 is formed at the top end portion of the linear fastener element row 4 of one fastener stringer 2 as shown in FIG. 2, and the other top end stop 10 is formed at the top end portion of the linear fastener element row 4 of the other fastener stringer 2 as shown in FIG. 4. As shown in FIGS. 3 and 5, the top end stop 10 is attached to each of the opposing side edges 5 of the fastener tapes 3 by inserting the core thread 6 through the inside of the linear fastener element row 4, and sewing this core thread 6 with double chain stitch by use of the sewing thread 7. In this linear fastener element row 4, the top end stop 10 is formed by injection molding means with thermoplastic resin such as polyamide, polyacetal, polypropylene, or polybutylene terephthalate such that the plurality of adjoining linear fastener elements 21 at the top end portion are buried. The top end stop 10 is formed in such a manner that the resin covers surfaces of the plurality of linear fastener elements 21, and that the resin fills a gap 26 between the adjoining linear fastener elements 21 and an internal space surrounded by the coupling head 22, the upper leg portion 24, the lower leg portion 25 and the core thread 6, that is, a coupling space 27 in which a coupling head 22 of a mating linear fastener element 21 enters when the opposing linear fastener elements 21 engage each other.

According to this embodiment, the top end stop 10 is formed at the top end portion of each of the right and left fastener stringers 2 by burying and covering two linear fastener elements 21 with resin, so that a resin portion filling the coupling spaces 27 of the adjoining linear fastener elements 21 connect in back and forth directions through a filled resin portion in the gap 26 between the linear fastener elements 21. The resin portion filling the coupling spaces 27 of the linear fastener elements 21 provide parallelism to a longitudinal direction of the linear fastener element row 4 inside the main body portion 13 of the top end stop 10, and are disposed on a same line L connecting the coupling spaces 27.

The configuration of the top end stop 10 is defined so that the main body portion 13 buries and covers the plurality of linear fastener elements 21 at the top end portion of the linear fastener element row 4 as shown in FIGS. 2 to 6. The outer side surface 16 located on a side of the coupling head 22 of the linear fastener element 21 in the main body portion 13 slightly projects outwardly from a front end of the coupling head 22, and forms a plane substantially parallel to a tangent line connecting adjoining coupling heads 22. The main body portion 13 has the expanding portion 12 which expands outwardly on a side of the upper end surface 18 on the outer side surface 16, that is, on a side opposite to a bottom end surface 19 which adjoins the linear fastener element 21 not covered with the main body portion 13, so that the expanding portion 12 makes contact with a side surface of the diamond 30 formed on the body 29 of the slider 28. The expanding portion 12 tilts with a falling gradient toward the bottom end surface 19 from its expanding end portion to form a slope intersecting the outer side surface 16. The slope makes a surface contact with a side surface of the diamond 30.

The inner side surface 17 located on a side of the inverted portion 23 of the linear fastener element 21 in the main body portion 13 projects slightly inwardly of the fastener tape 3 with respect to the end portion of the inverted portion 23, and forms a plane substantially parallel to a tangent line connecting the end portions of the adjoining inverted portions 23. The projecting portion 11 projecting inwardly of the fastener stringer 2 is provided on the side of the upper end surface 18 of the inner side surface 17, that is, on a side opposite to the bottom end surface 19 which adjoins the linear fastener element not covered with the main body portion 13. The projecting portion is formed so as to make contact with the front end of the flange 31 formed in the body 29 of the slider 28 loaded on the fastener chain 1. More specifically, the top end stop 10 has the expanding portion 12 and the projecting portion 11 on an upper half portion on the side of the upper end surface 18 of the main body portion 13, and the upper half portion is formed wide in a width direction. On the other hand, a lower half portion on the side of the lower end surface 19 of the main body portion 13 has a slightly larger width than a dimension from the end portion of the coupling head 22 up to the end portion of the inverted portion 23 of the buried liner fastener element 21, and the lower half portion is formed narrower than the upper half portion. Further, the top end stop 10 is entirely formed with an equal thickness, so that an inner face of the body 29 of the slider 28 does not need to be processed in any way.

Because the front surface portion 14 of the main body 13 buries the plurality of linear fastener elements 21 therein, the front surface portion 14 is formed in a larger thickness than that of the linear fastener element 21. On the other hand, the rear surface portion 15 is formed in a smaller thickness than that of the front surface portion 14 because nothing is buried therein. The rear surface portion 15 is not an indispensable component for the top end stop 10, and a top end stop 10 having no rear surface portion 15 can exist. The provision of the rear surface portion 15 allows the rear surface portion 15 to cover the rear surface of the fastener tape 3 in a contact state when the top end stop 10 is attached to the linear fastener element row 4. Consequently, the contact area between the top end stop 10 and the fastener tape 3 increases to improve the attachment strength of the top end stop 10.

Figure 7:
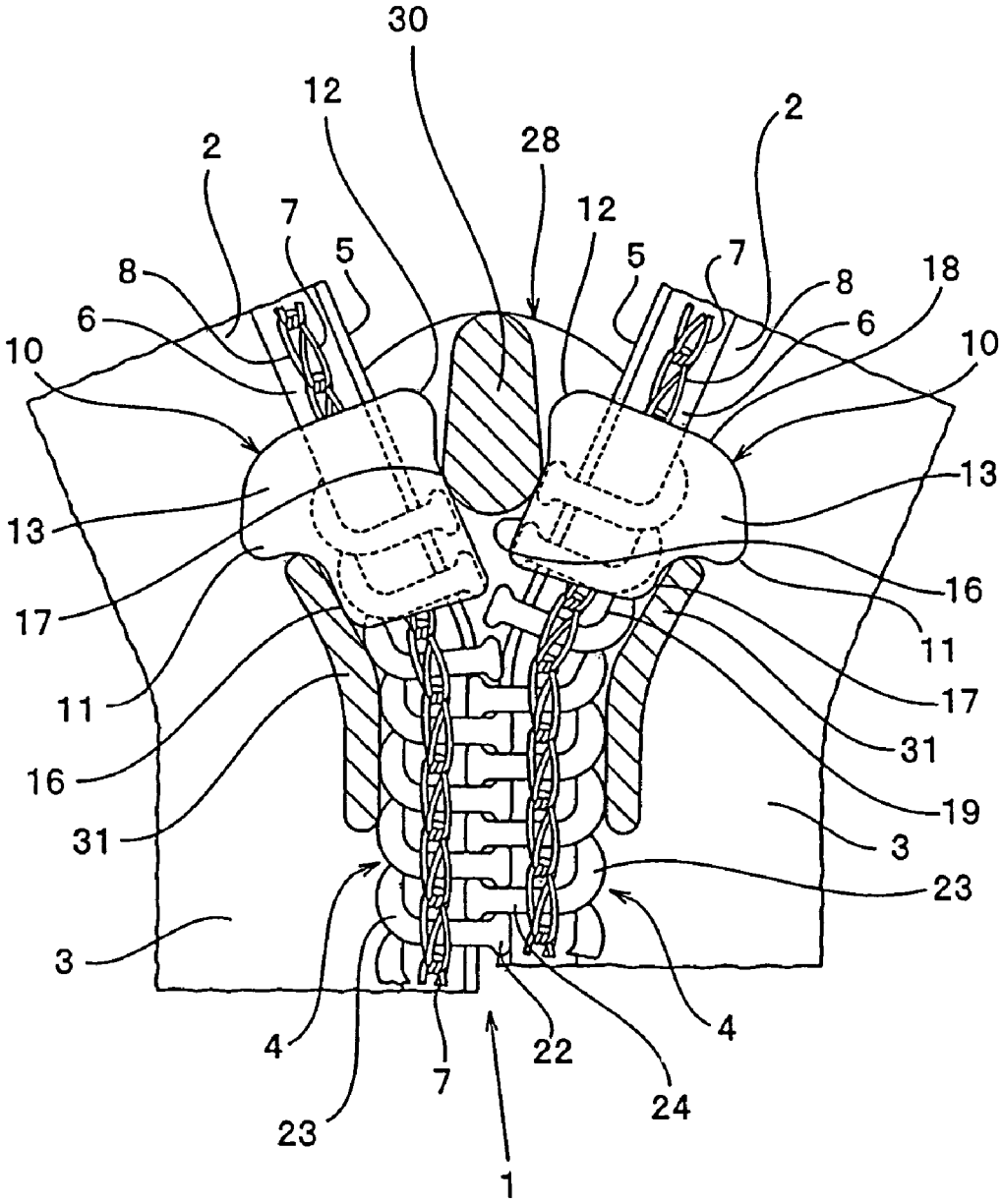
FIG. 7 is a sectional view of major portions of a fastener chain with a top end stop.

As shown in FIG. 1, the slide fastener may be formed to be openable by injection-molding an opening device 33 including a box 34, a box pin 35 and an insert pin 36 in a vicinity of the bottom end portion of the linear fastener element row 4 by use of thermoplastic resin such as polyamide, polyacetal, polypropylene, or polybutylene terephthalate. Further, it may be formed to be closed by attaching an appropriate bottom end stop instead of the opening device 33. As shown in FIG. 7, the respective linear fastener element rows 4 of the right and left fastener stringers 2 move through a Y-shaped element guide groove 32 formed inside the body 29 of the slider 28, thereby enabling engagement or disengagement of the coupling heads 22 of the linear fastener elements 21. The Y-shaped guide groove 32 is formed by disposing the diamond 30 on a side of a shoulder mouth of the body 29, that is, on a front end side in back and forth directions of the body 29 and by disposing the flanges 31 on both right and left sides of the body 29. As a result, when the linear fastener elements 21 move in the guide groove 32, the side surface of the diamond 30 faces the coupling heads 22 of the linear fastener elements 21 moving in the guide groove 32 while an inner face of the flange 31 faces the inverted portion 23 of the linear fastener elements 21 moving in the guide groove 32, thereby guiding a movement of the linear fastener elements 21 in the guide groove 32.

Even when the body 29 of the slider 28 collides with the top end stop 10 after the slider 28 slides as shown in FIG. 7, most portion of the top end stop 10 is accommodated inside the body 29 of the slider 28. Accordingly, the projecting portion 11 of the top end stop 10 makes contact with the front end of the flange 31 formed in the body 29, and the expanding portion 12 of the top end stop 10 makes contact with the diamond 30 formed in the body 29 of the slider 28. As a consequence, the top end stop 10 cannot pass the guide groove 32 of the slider 28, which stops the slider 28 easily.

When an excessive pulling force is applied to the slider 28 kept in contact with the projecting portion 11 of the top end stop 10, the top end stop 10 rotates around a contact portion between the projecting portion 11 and the flange 31 of the slider 28, so that the expanding portion 12 of the top end stop 10 makes contact with a side surface of the diamond 30 of the slider 28. At this time, as for the relation between the top end stop 10 and the slider 28, the projecting portion 11 of the top end stop 10 makes contact with the flange 31 of the slider 28 while the expanding portion 12 of the top end stop 10 makes contact with the side surface of the diamond 30 of the slider 28, so that the top end stop 10 and the slider 28 make contact with each other at two positions. As a consequence, an action of the top end stop 10 to pass the guide groove 32 is stopped securely to prevent the slider 28 from slipping out of the fastener chain 1.

Second Embodiment

Figure 8:
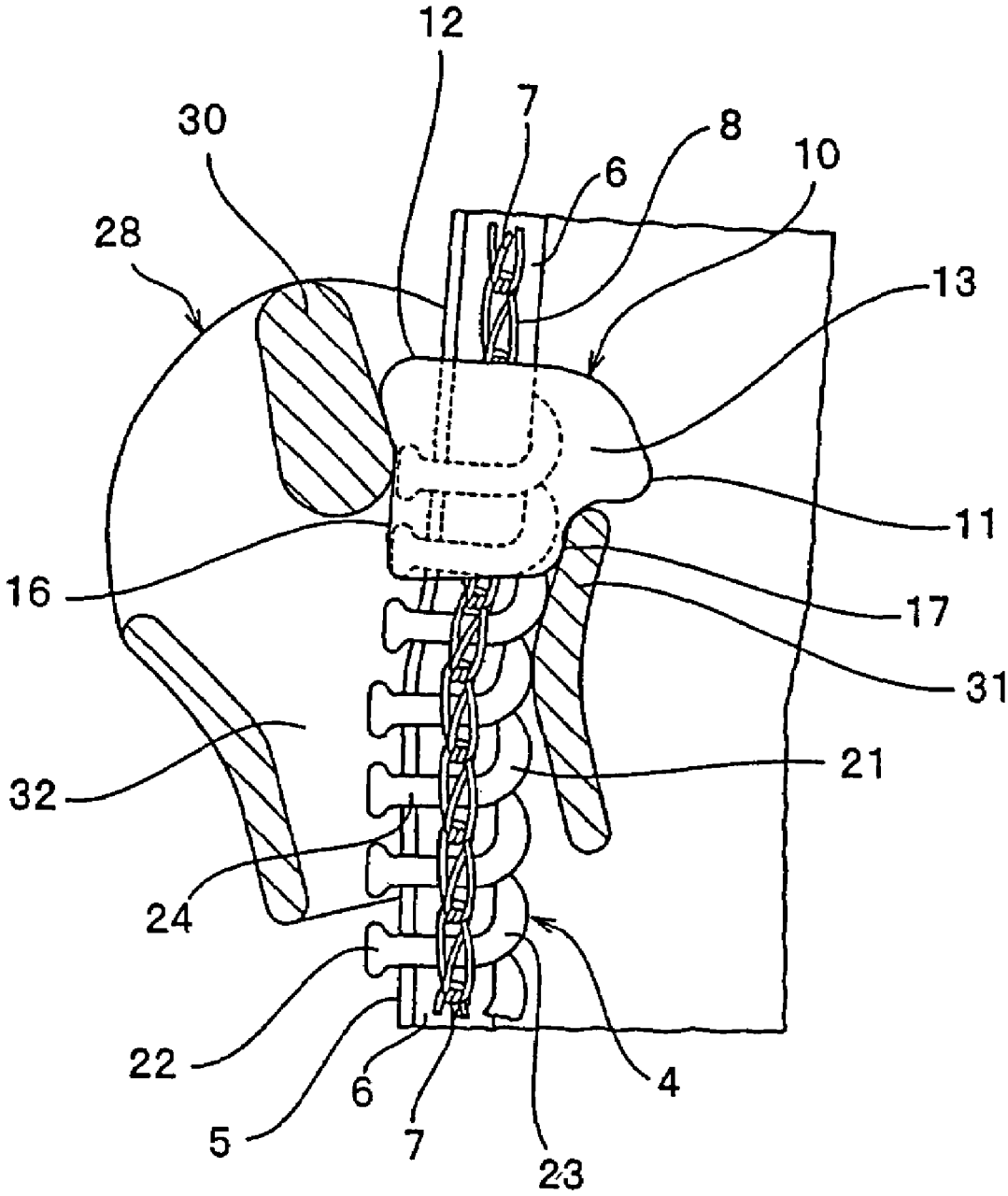
FIG. 8 is a sectional view of major portions of a fastener stringer with a top end stop, according to a second embodiment of the invention.
Figure 9:
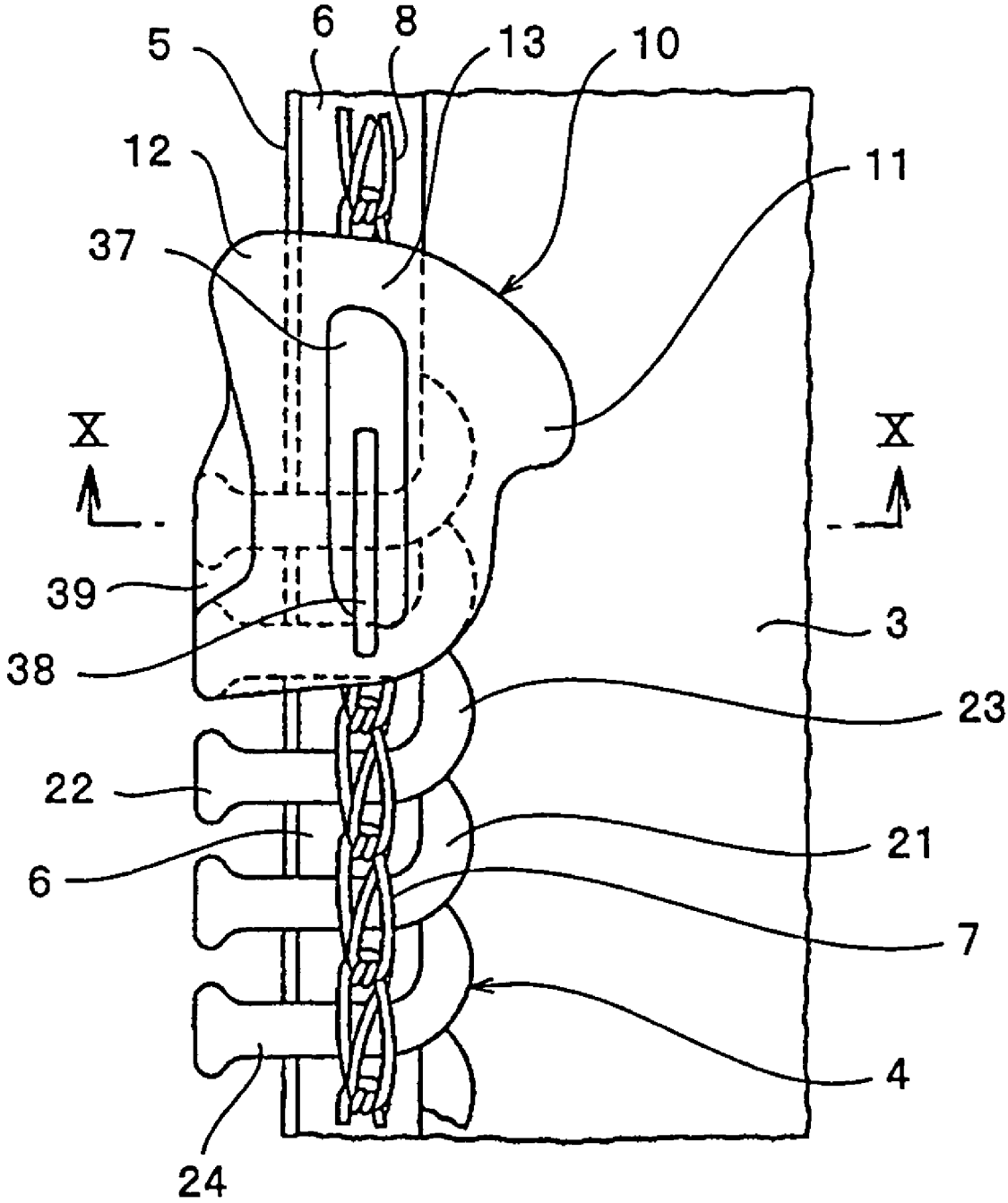
FIG. 9 is a front view of a top end stop according to a third embodiment of the invention disposed on one fastener stringer.

As shown in FIG. 8, a top end stop of a slide fastener having a linear fastener element row according to a second embodiment of the present invention has a feature in that the top end stop 10 is formed on only one fastener stringer 2 of the fastener chain 1, although when the opening device 33 is attached to a bottom end of the linear fastener element row 4, the top end stop 10 is attached to the top end portion of the linear fastener element row 4 provided with the box pin 35 while whether or not the same top end stop 10 is attached to the fastener stringer 2 on the side of the insert pin 36 can be determined freely.

The top end stop 10 prevents the slider from slipping out from the top end of the linear fastener element row 4 on the side at which the box pin 35 is attached. When the slider 28 is pulled strongly, the projecting portion 11 of the top end stop 10 makes contact with the front end of the flange 31 within the guide groove 32 of the body 29 while the expanding portion 12 rotates to the side of the diamond 30 and makes contact therewith, thereby blocking the top end stop 10 from invading further into the guide groove 32. In the meantime, the top end stop 10 may be attached to only one fastener stringer 2 even if the end portion of the fastener chain 1 is designed to be closed.

Third Embodiment

A top end stop of a slide fastener having a linear slide fastener element row according to a third embodiment of the present invention shown in FIGS. 9 to 13 has a feature in that the fastener element row 4 with the core thread 6 inserted therein is attached to an opposing side edge 5 of each of the fastener tapes 3 by sewing with the sewing thread 7 of a double chain stitch so as to complete the fastener stringer 2. A space portion 8 with the linear fastener element rows 4 removed is formed at an end portion of the fastener stringer 2, where the top end stop 10 is formed in a shape burying and covering a plurality of the linear fastener elements 21 existing at the end portion. The top end stop 10 is injection molded with thermoplastic resin on a single surface of the fastener tape 3 on a side with the linear fastener element row 4. Of course, as shown in FIG. 3, it is possible to form the top end stop 10 in a shape nipping the fastener tape 3.

In order to form the space portion 8 having no linear fastener element row 4 at a predetermined position of the fastener stringer 2, the upper leg portion 24 and the lower leg portion 25 on a side of the coupling head 22 of the linear fastener element row 4 which project from the opposing side edge 5 of the fastener tape 3 are cut by a predetermined length and pulled from a side of the inverted portion 23 so as to pull out and remove the linear fastener element row 4 from the sewing thread. As a result, when the top end stop 10 is injection molded with the sewing thread of the double chain stitch slacking, the sewing thread is easily deflected by an injection pressure and exposed on a front surface of the top end stop 10.

In this embodiment, an improvement is added in consideration of the above-mentioned problem. That is, the top end stop 10 is formed on an upper place of the sewing thread 7 for sewing a plurality of the linear fastener elements 21 facing the space portion 8 of the fastener stringer 2, wherein a protrusion 37 protruding on a front surface of the main body portion 13 of the top end stop 10 is formed for preventing the sewing thread 7 beforehand from being exposed on the front surface even if the sewing thread 7 is deflected by an injection pressure. The protrusion 37 is disposed above the linear fastener element 21 at a top end of the linear fastener element row 4 which is adjoining to the space portion 8 and one of the plurality of the linear fastener element 21 buried in the main body portion 13. This is because the sewing thread for fixing the linear fastener element 21 at the top end tends to be slack by an influence of the sewing thread 7 in the space portion 8 in the slack state and easy to be deflected by the injection pressure. On the other hand, a groove 38 in a concave shape is formed at a center portion of the sewing thread for sewing the linear fastener element 21 positioned at the top end of the fastener stringer 2 so that the sewing thread 7 is pressed to the fastener tape 3 in a manner straddling the upper leg portion 24 of the linear fastener element 21 in injection molding the top end stop 10, thereby preventing the sewing thread 7 beforehand from being deflected.

Figure 10:
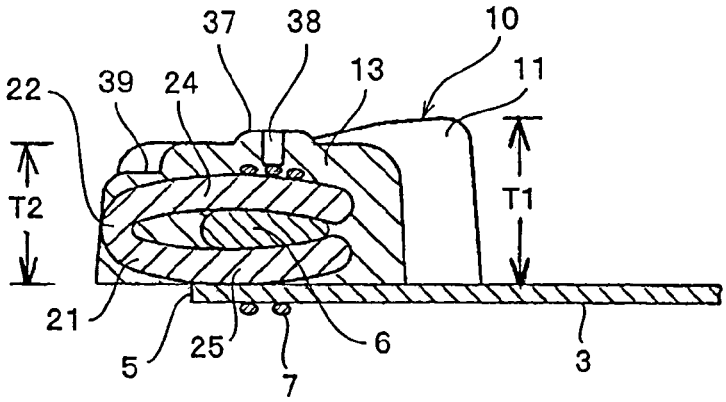
FIG. 10 is a sectional view of the top end stop taken along the line X-X in FIG. 9.

Furthermore, as shown in FIG. 10, in the top end stop 10, the projecting portion 11 is formed in such a manner that a front surface of the projecting portion 11 is protruded higher that a front surface of the main body portion 13. For example, as shown in the drawing, when a height T2 from a front surface of the fastener tape 3, i.e., a rear surface of the main body portion 13 to the front surface of the main body portion 13 and a height T1 from the front surface of the fastener tape 3 to a front surface of the projecting portion 11 are compared on a basis of the front surface of the fastener tape 3, a condition of T2>T1 is satisfied. With this condition, a portion to be contact with the flange 31 of the slider 28 is protruded to be thick and strong, whereby the projecting portion 11 is not broken if the flange 31 of the slider 28 hit the projecting portion 11 hard.

Figure 11:
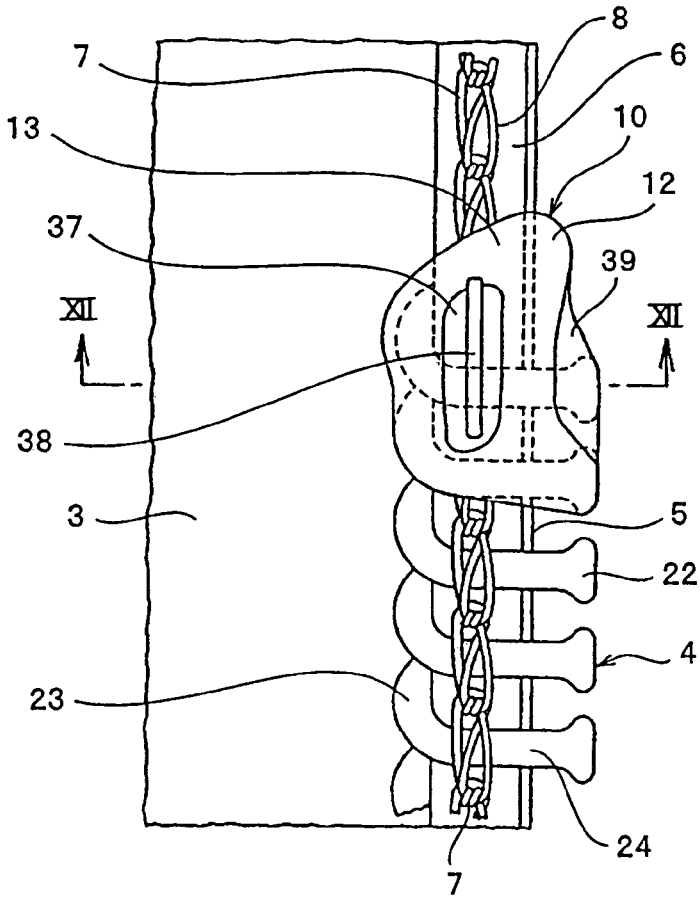
FIG. 11 is a front view of the top end stop disposed on the other fastener stringer.
Figure 12:
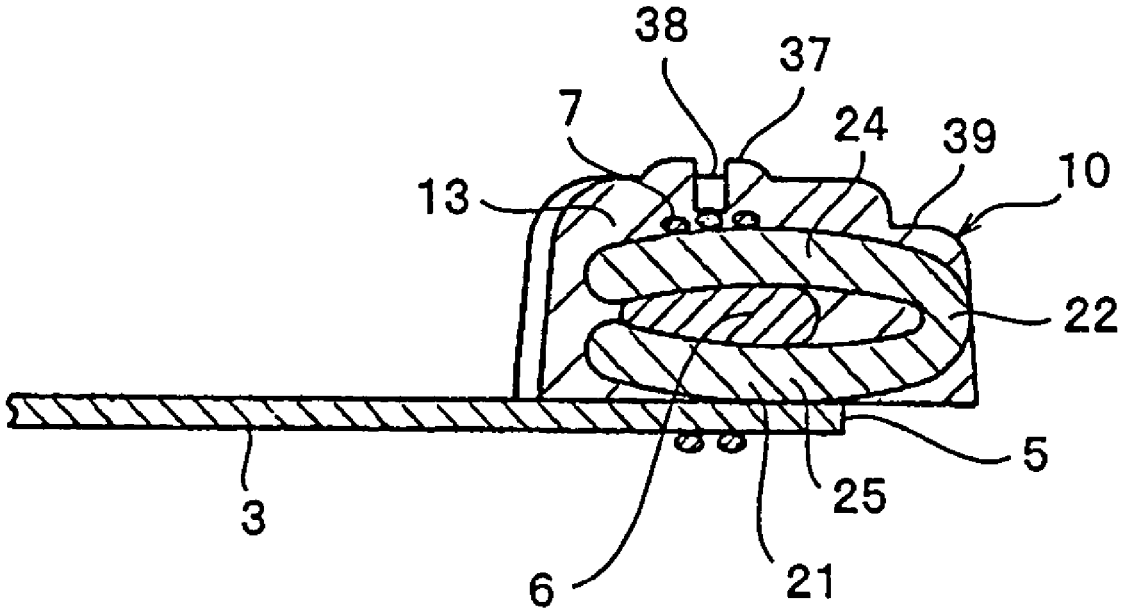
FIG. 12 is a sectional view of the top end stop taken along the line XII-XII in FIG. 11.
Figure 13:
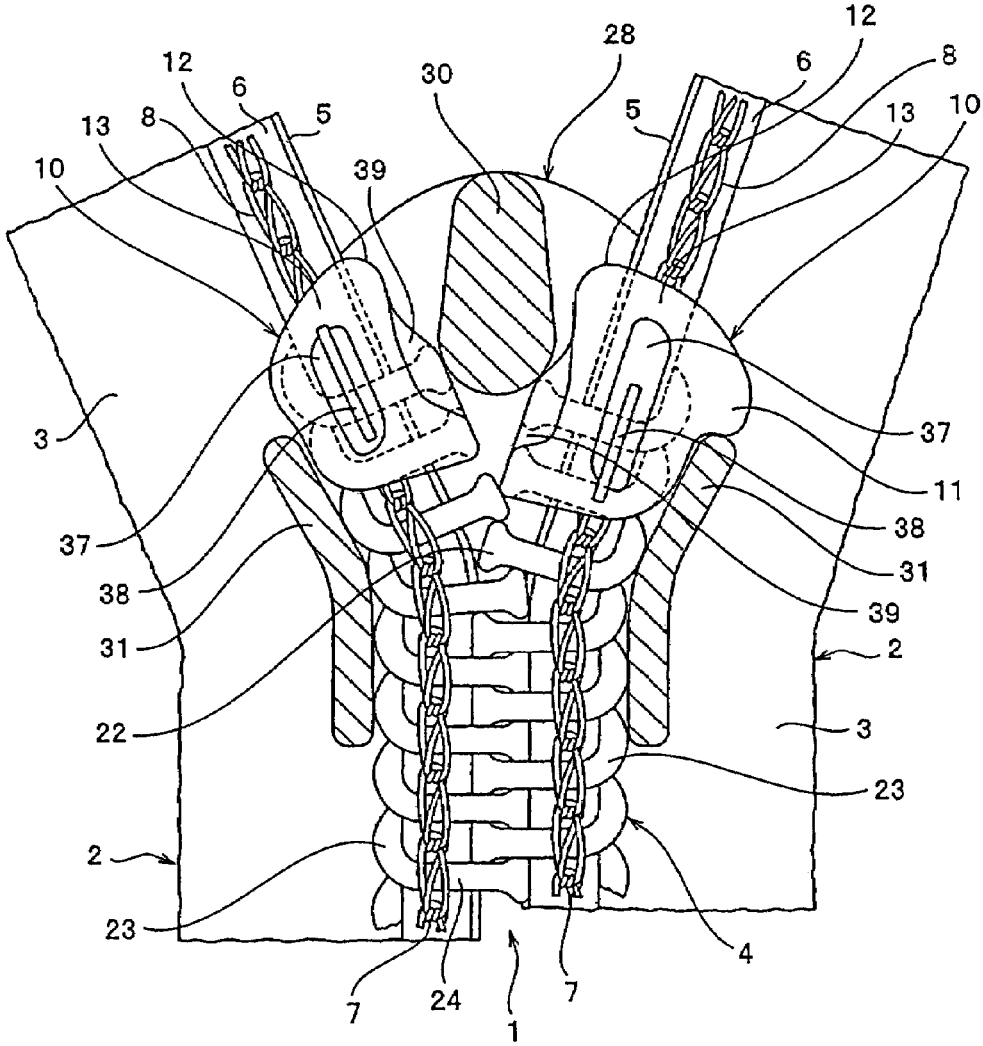
FIG. 13 is a sectional view of major portions of a fastener chain with the top end stop.

A top end stop 10 shown in FIGS. 11 and 12 does not have the projecting portion 11 with a function for preventing a slipping out by contacting with the flange 31 of the slider 28 on a side thereof. However the top end stop 10 comprises the protrusion 37 and the groove 38 on the sewing thread 7 for sewing the plurality of the linear fastener element 21 facing the space portion 8, thereby preventing the sewing thread from being deflected. A fastener stringer 2 with this top end stop 10 is used in pair with the fastener stinger 2 shown in FIG. 9 and, for example, it is used in a state shown in FIG. 13. When it is actually used, a box pin 35 is attached on a bottom portion of the fastener stringer 2 on a side of the top end stop 10 having the projecting portion 11 while an insert pin 36 is attached to a bottom portion of the fastener stringer 2 on a side of the top end stop 10 without the projecting portion 11 so as to be formed in a shape appropriate to the fastener chain 1 used as an opening device or a reverse opening device.

Meanwhile, as shown in FIGS. 9 to 13, it is possible to reduce an amount of material by forming a step portion 39 in which the front surface of the main body portion 13 of the top end stop 10 on a side of the coupling head portion 22 sinks deeper.

Fourth Embodiment

Figure 14:
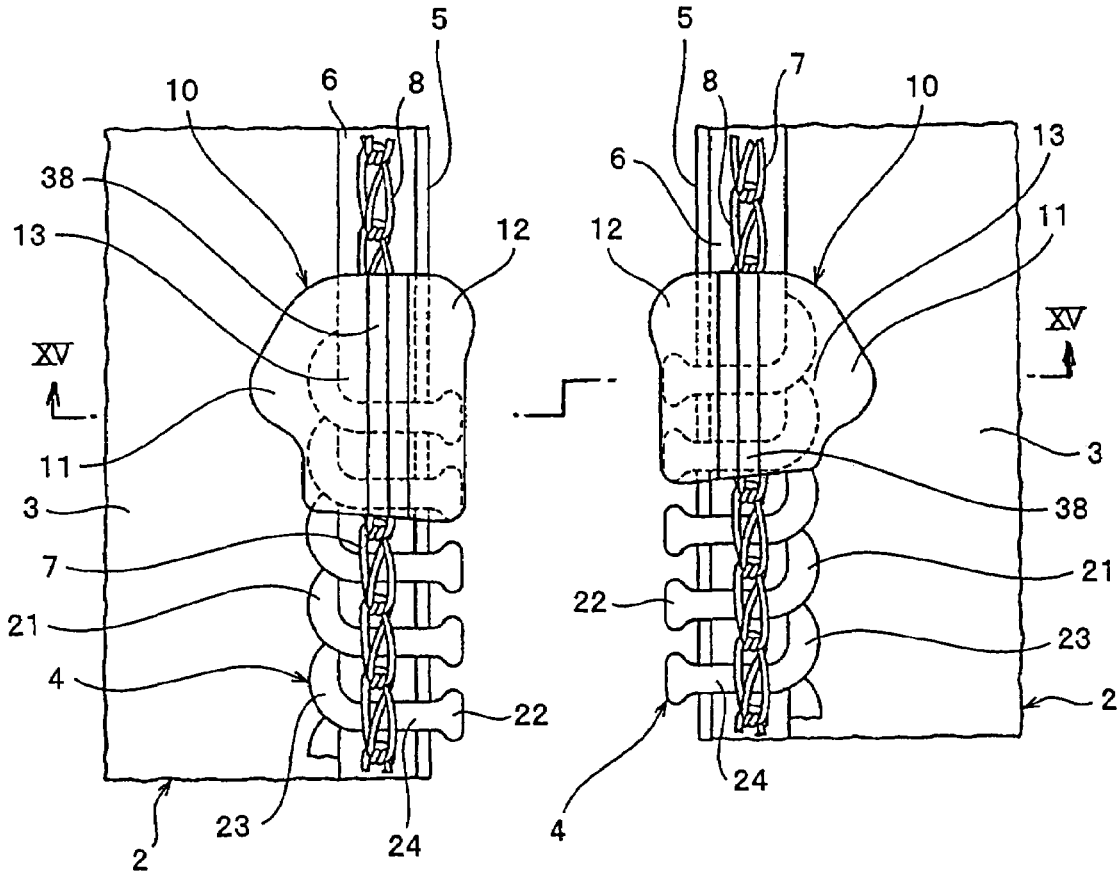
FIG. 14 is a front view of a fastener chain with a top end stop according to a fourth embodiment of the invention.
Figure 15:
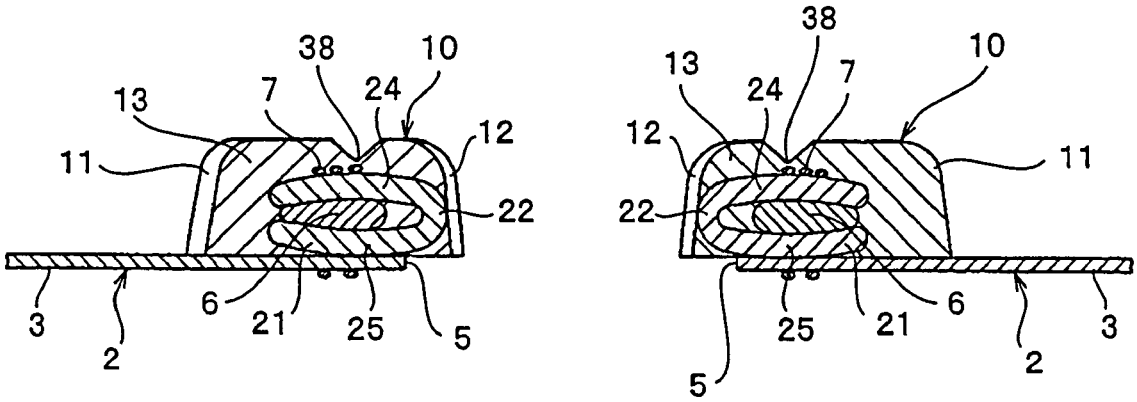
FIG. 15 is a sectional view of the top end stop taken along the line XV-XV in FIG. 14.

A top end stop 10 of a slide fastener having a linear slide fastener element row according to a fourth embodiment of the present invention shown in FIGS. 14 and 15 has a feature in that the fastener element row 4 with the core thread 6 inserted therein is attached to an opposing side edge 5 of each of the fastener tapes 3 by sewing with the sewing thread 7 of a double chain stitch. A top end stop 10 is injection molded with thermoplastic resin on a single surface of the fastener tape 3 in a shape burying and covering the plurality of the linear fastener elements 21 facing the space portion 8 from which the linear fastener element row 4 of the fastener stringer 2 is removed. A plane shape of the top end stop 10 to be molded has a substantially same shape as that of the first embodiment. The right and left top end stops 10 both have a shape having the projecting portion 11 to be contact with the flange 31 of the slider 28 and the top end stops 10 are molded on the surface of the fastener tape 3 on which the linear fastener element row 4 is sewed. These fastener stringers 2 are used for a slide fastener in a large size and it is possible to form each of the top end stops 10 in a shape nipping the fastener tape 3.

In the front surface of the main body portion 13, the top end stop 10 has a groove 38 in a V shape carved in an entire length of the top end stop 10 on an upper side, i.e., on a position along the sewing thread of the fastener stringer 2. By providing this groove 38, in injection molding, a projecting ridge for forming the groove 38 in a molding die prevents the sewing thread 7 at all place to be buried in the top end stop 10 from being deflected by the injection pressure, thereby preventing the sewing thread 7 from being exposed on the front surface of the top end stop 10.

Fifth Embodiment

Figure 16:
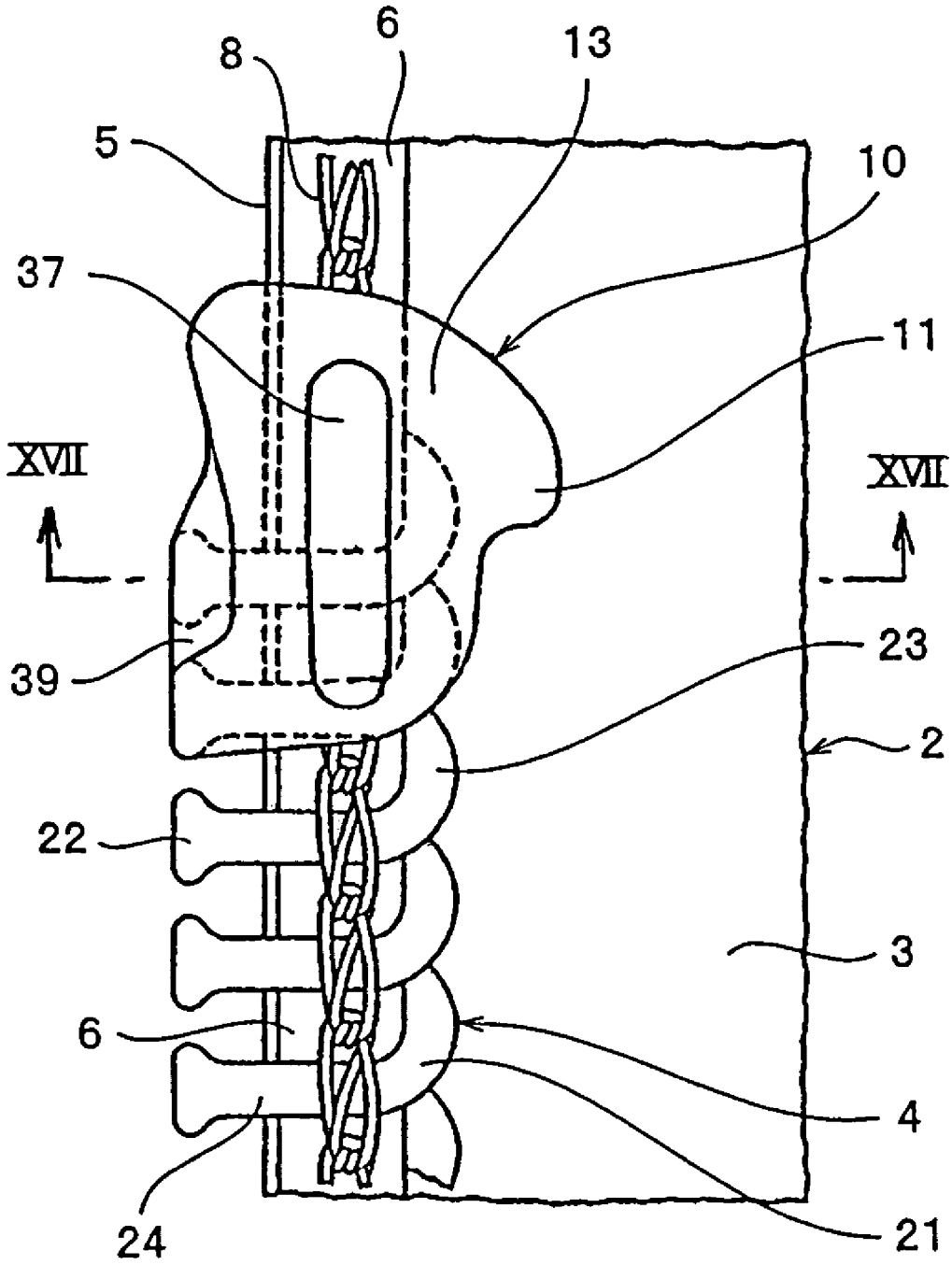
FIG. 16 is a front view of a fastener stringer with a top end stop according to a fifth embodiment of the invention.
Figure 17:
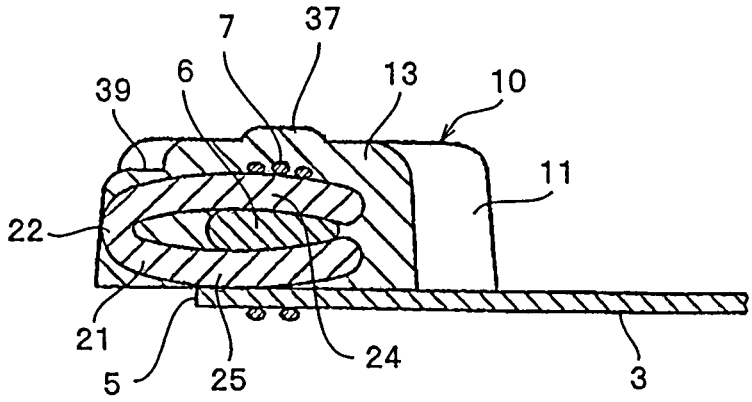
FIG. 17 is a sectional view of the top end stop taken along the line XVII-XVII in FIG. 16.

A top end stop 10 of a slide fastener having a linear slide fastener element row according to a fifth embodiment of the present invention shown in FIGS. 16 and 17 has a feature in that the fastener element row 4 with the core thread 6 inserted therein is attached to an opposing side edge 5 of each of the fastener tapes 3 by sewing with the sewing thread 7 of a double chain stitch. A top end stop 10 is injection molded with thermoplastic resin on a single surface of the fastener tape 3 in a shape burying and covering the plurality of the linear fastener elements 21 facing the space portion 8 from which the linear fastener element row 4 of the fastener stringer 2 is removed. A plane shape of the top end stop 10 to be molded has a substantially same shape as that of the third embodiment comprising the main body portion 13 having the projecting portion 11 to be in contact with the flange 31 of the slider 28.

On the front surface of the main body portion 13 of the top end stop 10, a protrusion 37 protruded toward an upper side, i.e., above a position along the sewing thread of the fastener stringer 2 is formed on the plurality of the linear fastener elements 21. The protrusion 37 is formed in a shape being inserted into the guide groove 32 of the slider 28 so that a front end of the flange 31 of the slider 28 is in contact with the projecting portion 11 of the top end stop 10. By forming the protrusion 37 on the front surface of the top end stop 10, rattling in the guide groove 32 of the slider 28 is eliminated and an exposure of the sewing thread 7 on the front surface of the top end stop 10 is prevented beforehand even if the sewing thread 7 is deflected by the injection pressure in molding the top end stop 10.

Sixth Embodiment

Figure 18:
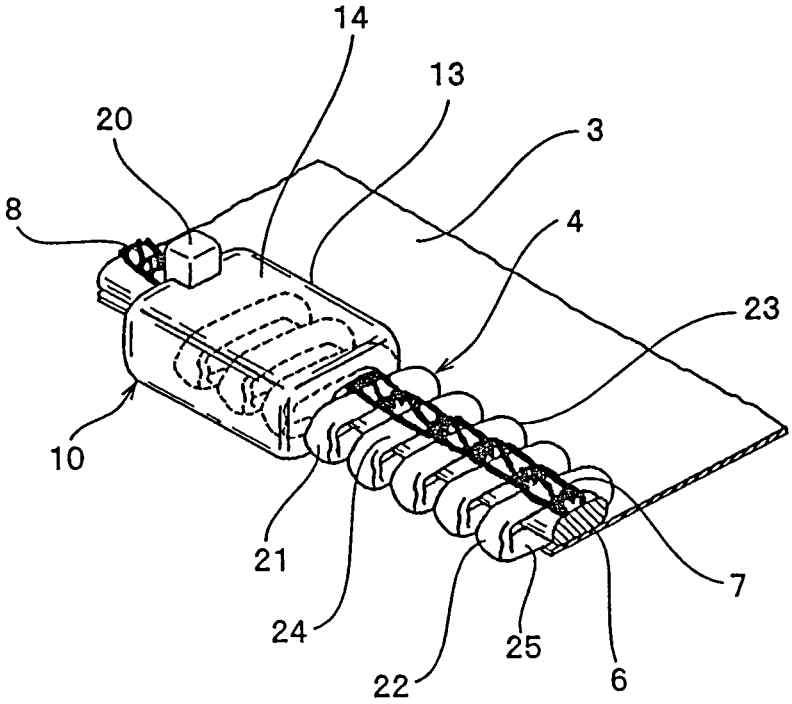
FIG. 18 is a perspective view of a fastener stringer with a top end stop, according to a third embodiment of the invention.
Figure 19:
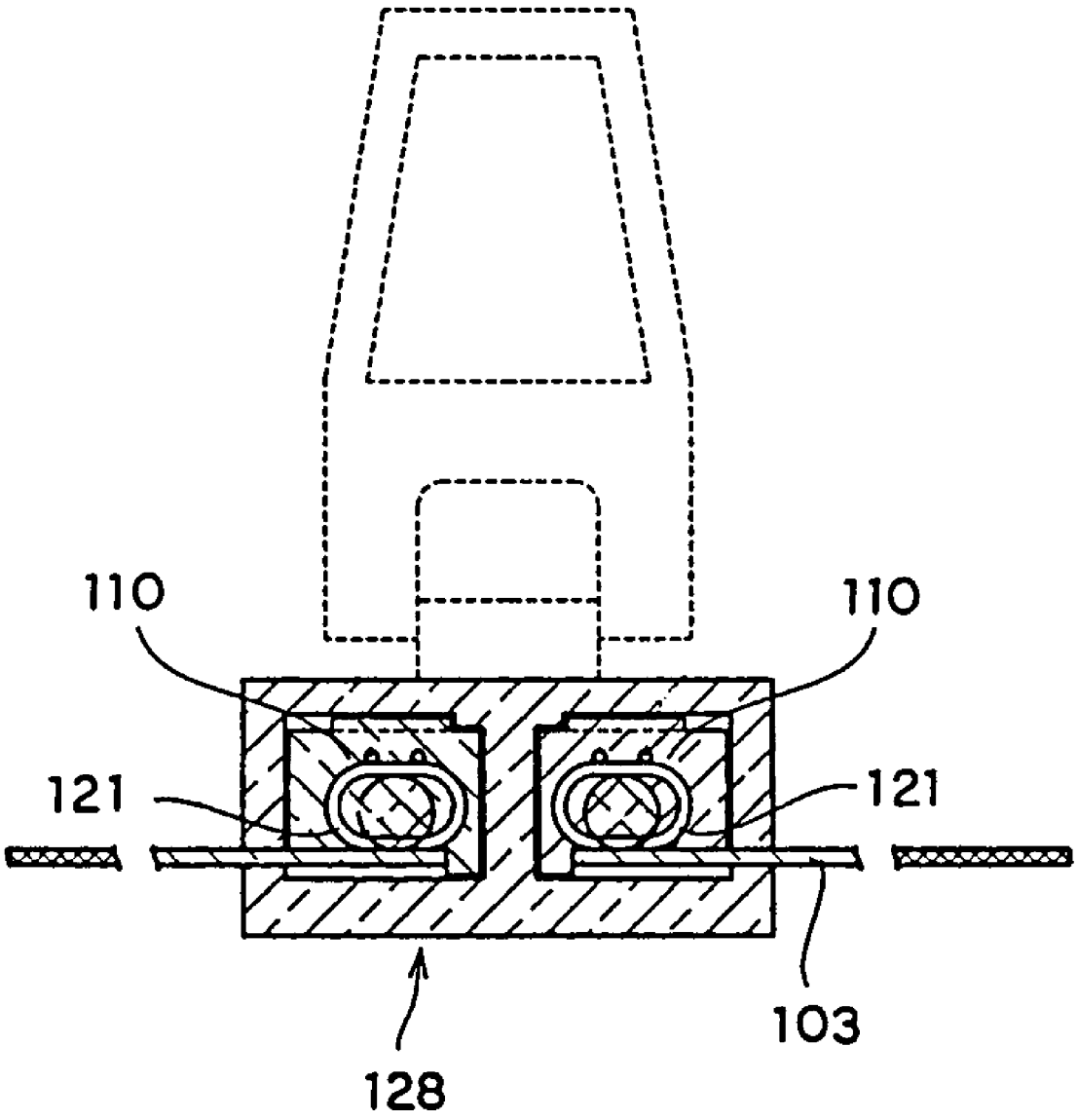
FIG. 19 PRIOR ART
FIG. 19 is a perspective view showing a well-known top end stop and slider.

A top end stop of a slide fastener having a linear slide fastener element row according to a sixth embodiment of the present invention shown in FIG. 18 will be described below. The top end stop 10 attached to the top end of the linear fastener element row 4 in the fastener stringer 2 with injection molding means is molded so as to bury and cover a plurality of linear fastener elements 21 located at the top end. At this time, not only the linear fastener elements 21 but also the inserted core thread 6, the sewed sewing thread 7 and the side edge of the fastener tape 3 are buried with the top end stop 10. According to this embodiment, the top end stop 10 buries and covers three linear fastener elements 21.

The top end stop 10 is formed entirely in an equal thickness and accommodated in the body 29 of the slider 28. A protrusion 20 protruding outwardly is provided on the front surface portion 14 of the main body portion 13 of the top end stop 10 in order to stop the slider 28 without installing the projecting portion 11 and the expanding portion 12 as mentioned in the previous embodiment. This makes it possible to stop the slider 28 by bringing it into contact with the end portion on the shoulder mouth side of the body 29 of the slider 28.

A fastener chain in which the top end stop is molded on a fastener stringer thereof by covering a gap among a plurality of linear fastener elements with synthetic resin is used at opening portions in clothes such as fly of clothes, bags and other products.

What is claimed is:

1. A slide fastener comprising a linear fastener element row attached along each of opposing side edges of fastener tapes and a top end stop made of synthetic resin attached to a top end portion of each of the linear fastener element rows, wherein the each top end stop covers a plurality of adjoining linear fastener elements and fills among the linear fastener elements to form a main body portion and wherein the linear fastener element row is sewed on each of the fastener tapes and a groove is carved in a front surface portion of the main body portion on an upper side of a sewing thread.

2. The slide fastener according to claim 1, wherein the top end stop has a projecting portion which projects from an inner side surface located inside of one of the fastener tapes in the main body portion and which makes contact with a flange of a slider.

3. The slide fastener according to claim 1, wherein the top end stop has an expanding portion which expands from an outer side surface located outside of one of the fastener tapes on an opposite side to the inner side surface in the main body portion and which makes contact with a diamond of the slider.

4. The slide fastener according to any one of claims 2 and 3, wherein the projecting portion and the expanding portion formed on the main body portion are located at an upper end side of the inner side surface and the outer side surface.

5. The slide fastener according to claim 1, wherein the main body portion has a front surface portion in which the plurality of linear fastener elements are buried, the front surface portion being formed on a front surface side of each of the fastener tapes, and a rear surface portion being formed on a rear surface side of each of the fastener tapes.

6. The slide fastener according to claim 1, wherein the linear fastener element row is sewed on each of the fastener tapes and a protrusion is protruded on a front surface portion of the main body portion on the upper side of the sewing thread.

7. The slide fastener according to claim 6, wherein the groove is in a concave shape and is carved in the protrusion formed on the main body portion.

8. The slide fastener according to claim 2, wherein the projecting portion formed on the main body portion is formed in a shape that a front surface of the projecting portion is protruded higher than a front surface of the main body portion.

* * * * *